US010826237B2

(12) United States Patent
Wu et al.

(10) Patent No.: US 10,826,237 B2
(45) Date of Patent: Nov. 3, 2020

(54) PLUG CONNECTOR

(71) Applicant: Cheng Uei Precision Industry Co., Ltd., New Taipei (TW)

(72) Inventors: Yun Wu, Dong-Guan (CN); Hsin-Min Chao, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/505,698

(22) Filed: Jul. 8, 2019

(65) Prior Publication Data

US 2020/0266581 A1 Aug. 20, 2020

(30) Foreign Application Priority Data

Feb. 19, 2019 (CN) ..... 2019 2 0208801 U

(51) Int. Cl.

| | |
|---|---|
| ***H01R 13/629*** | (2006.01) |
| ***H01R 24/60*** | (2011.01) |
| ***H01R 13/652*** | (2006.01) |
| ***H01R 13/648*** | (2006.01) |

(52) U.S. Cl.

CPC ..... *H01R 13/629* (2013.01); *H01R 24/60* (2013.01); *H01R 13/648* (2013.01); *H01R 13/652* (2013.01)

(58) Field of Classification Search

CPC ..... H01R 13/6597; H01R 13/6594; H01R 13/629; H01R 24/60; H01R 13/648; H01R 13/652

See application file for complete search history.

(56) References Cited

U.S. PATENT DOCUMENTS

| | | | | |
|---|---|---|---|---|
| 9,525,241 | B1 * | 12/2016 | Su | H01R 13/6581 |
| 9,577,387 | B2 * | 2/2017 | Hu | H01R 13/6597 |
| 9,954,317 | B2 * | 4/2018 | Zhao | H01R 12/58 |
| 2015/0244111 | A1 * | 8/2015 | Ju | H01R 24/60 439/607.05 |
| 2018/0097298 | A1 * | 4/2018 | Ju | H01R 13/6581 |

* cited by examiner

*Primary Examiner* — Nguyen Tran
*Assistant Examiner* — Paul D Baillargeon
(74) *Attorney, Agent, or Firm* — Cheng-Ju Chiang

(57) ABSTRACT

A plug connector includes a main body, a plurality of terminals, an insulating housing and a protecting portion. The main body includes a main plate, a base body assembled to the main plate, and an outer ground shell. The base body has an assembling end, and a connecting end connected with the assembling end. The outer ground shell is mounted around the assembling end. The plurality of the terminals mounted to the base body, include a plurality of ground terminals. Each terminal has a contact portion. The contact portions of the plurality of the terminals are exposed to the connecting end. The contact portion of each ground terminal has a soldering pad fastened to the main plate. The insulating housing surrounds the outer ground shell. The protecting portion surrounds front ends of the contact portions of the plurality of the terminals and a front end of the connecting end.

11 Claims, 6 Drawing Sheets

PLUG CONNECTOR

CROSS-REFERENCE TO RELATED APPLICATION

The present application is based on, and claims priority form, China Patent Application No. 201920208801.5, filed Feb. 19, 2019, the disclosure of which is hereby incorporated by reference herein in its entirety.

BACKGROUND OF THE INVENTION

1. Field of the Invention

The present invention generally relates to a connector, and more particularly to a plug connector preventing a ground terminal thereof from being deformed or broken.

2. The Related Art

In a process of manufacturing a conventional plug connector, the conventional plug connector includes a base body, a plurality of terminals and a protecting portion. The plurality of the terminals include two ground terminals. After the plurality of the terminals are assembled to the base body of the plug connector, the protecting portion is integrally molded to front ends of the base body and the plurality of the terminals by way of an envelop injection to fasten and protect the plurality of the terminals. When a user inserts the plug connector into a docking port, the user will shake the plug connector leftward and rightward to confirm whether the plug connector is connected in place, if the plug connector is without being connected in place, or the plug connector is pulled accidentally and carelessly, two elastic pieces mounted to two sides of the docking port for fastening or loosening the plug connector will be caused to abrade plastics of two sides of the protection portion.

However, when the plug connector is inserted into or withdrawal from the docking port again, because the plastics of the two sides of the protecting portion are abraded, the two ground terminals disposed to two sides of the plug connector are abraded, a deformation or breakage phenomenon of the ground terminals is easily caused, and a normal use and a life of the plug connector are affected.

SUMMARY OF THE INVENTION

An object of the present invention is to provide a plug connector. The plug connector includes a main body, a plurality of terminals, an insulating housing and a protecting portion. The main body includes a main plate, a base body assembled to the main plate, and an outer ground shell. The base body has an assembling end, and a connecting end connected with a front of the assembling end. The outer ground shell is mounted around the assembling end. The main plate has a base plate disposed horizontally. Two sides of a front end of the base plate are defined as two connecting plates. Two opposite outer surfaces of the two connecting plates are arched oppositely outward. Two opposite sides of a front end of the connecting end are recessed inward to form two locking grooves corresponding to the two connecting plates, respectively. The plurality of the terminals mounted to the base body, include a plurality of ground terminals and a plurality of signal terminals. The plurality of the ground terminals are mounted to two opposite sides of the base body. The plurality of the signal terminals are mounted to a middle of the base body and disposed among the plurality of the ground terminals. Each terminal has a contact portion, a connecting portion connected with a rear end of the contact portion, and a soldering portion connected with a rear end of the connecting portion. The contact portions of the plurality of the terminals are exposed to a top surface and a bottom surface of the connecting end. The connecting portions of the plurality of the terminals are mounted to a junction between the connecting end and the assembling end, and the soldering portions of the plurality of the terminals project out of a rear surface of the assembling end. The contact portion of each ground terminal has a soldering pad fastened to the main plate. A free end of the contact portion of each ground terminal is folded to form a propping portion, and the propping portion faces to and is parallel with the contact portion of each ground terminal. The propping portion and the contact portion are integrally formed to each ground terminal. An inner side of the propping portion of each ground terminal extends towards the connecting end to form the soldering pad. The soldering pads of the plurality of the ground terminals are received in the two locking grooves. The soldering pads of the plurality of the ground terminals are fastened to and connected with the two connecting plates of the main plate. The insulating housing surrounds and is integrally molded to the outer ground shell by way of an envelope envelop injection. The protecting portion surrounds and is integrally molded to front ends of the contact portions of the plurality of the terminals and a front end of the connecting end by way of the envelop injection.

Another object of the present invention is to provide a plug connector. The plug connector includes a main body, a plurality of terminals, an insulating housing and a protecting portion. The main body includes a main plate, a base body assembled to the main plate, and an outer ground shell. The base body has an assembling end, and a connecting end connected with a front of the assembling end. The outer ground shell is mounted around the assembling end. The base body includes an upper base body and a lower base body. The outer ground shell includes an upper ground shell and a lower ground shell. The upper ground shell has a U-shaped upper assembling portion of which a mouth faces downward, and two upper connecting pieces extended oppositely outward from two opposite sides of the upper assembling portion. The lower ground shell has a U-shaped lower assembling portion of which a mouth faces upward, and two lower connecting pieces extended oppositely outward from two opposite sides of the lower assembling portion. The upper assembling portion is mounted to the upper base body, and the lower assembling portion is mounted to the lower base body. The main plate has a base plate. Rears of two opposite sides of the base plate protrude oppositely and then extend rearward to form two extending plates, one extending plate is clamped between one upper connecting piece and one lower connecting piece facing the one upper connecting piece, the other extending plate is clamped between the other upper connecting piece and the other lower connecting piece. The plurality of the terminals mounted to the base body, include a plurality of ground terminals mounted to two opposite sides of the base body. Each terminal has a contact portion, a connecting portion connected with a rear end of the contact portion, and a soldering portion connected with a rear end of the connecting portion. The contact portions of the plurality of the terminals are exposed to a top surface and a bottom surface of the connecting end, and the soldering portions of the plurality of the terminals project out of a rear surface of the assembling end. A free end of the contact portion of each ground terminal is folded to form a propping portion. An inner side of the propping portion of each ground terminal extends towards the connecting end to form a soldering pad. The soldering pads of the plurality of the ground terminals are received in the two lacking locking grooves. The soldering pads of the plurality of the ground terminals are fastened to and connected with the two connecting plates of the main plate. The insulating housing surrounds and is integrally molded to the outer ground shell. The protecting portion surrounds and is integrally molded to front ends of the contact portions of the plurality of the terminals and a front end of the connecting end.

Another object of the present invention is to provide a plug connector. The plug connector includes a main body, a plurality of terminals, an insulating housing and a protecting portion. The main body includes a main plate, a base body assembled to the main plate, and an outer ground shell. The base body has an assembling end, and a connecting end connected with a front of the assembling end. The outer ground shell is mounted around the assembling end. The main plate has a base plate. Two sides of a front end of the base plate are defined as two connecting plates. Two opposite sides of a front end of the connecting end are recessed inward to form two locking grooves, respectively. The plurality of the terminals mounted to the base body, include a plurality of ground terminals mounted to two opposite sides of the base body. Each terminal has a contact portion, a connecting portion connected with a rear end of the contact portion, and a soldering portion connected with a rear end of the connecting portion. The contact portions of the plurality of the terminals are exposed to a top surface and a bottom surface of the connecting end, and the soldering portions of the plurality of the terminals project out of a rear surface of the assembling end. A free end of the contact portion of each ground terminal is folded to form a propping portion. An inner side of the propping portion of each ground terminal extends towards the connecting end to form a soldering pad. The soldering pads of the plurality of the ground terminals are received in the two lacking locking grooves. The soldering pads of the plurality of the ground terminals are fastened to and connected with the two connecting plates of the main plate. The insulating housing surrounds and is integrally molded to the outer ground shell. The protecting portion surrounds and is integrally molded to front ends of the contact portions of the plurality of the terminals and a front end of the connecting end.

As described above, when the plug connector is used in insertion and withdrawal processes, in order to avoid a tilt phenomenon or a deformation phenomenon of first contact portions of the plurality of the ground terminals and second contact portions of the plurality of the signal terminals being caused, the protecting portion is integrally molded to the front end of the connecting end by way of the envelop injection, so interstices between the connecting end and the main plate, and gaps among the plurality of the terminals are sealed, thereby the plug connector has a waterproof function. Furthermore, the propping portions of the plurality of the ground terminals increase bearing forces and the soldering pads of the plurality of the ground terminals are soldered to the two connecting plates of the main plate, even though two elastic pieces of two opposite sides of a docking port abrade plastics of two sides of the protecting portion, the plug connector prevents each ground terminal thereof from being deformed or broken, so that each ground terminal is uneasily deformed or broken. As a result, a normal use and a life of the plug connector is ensured.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
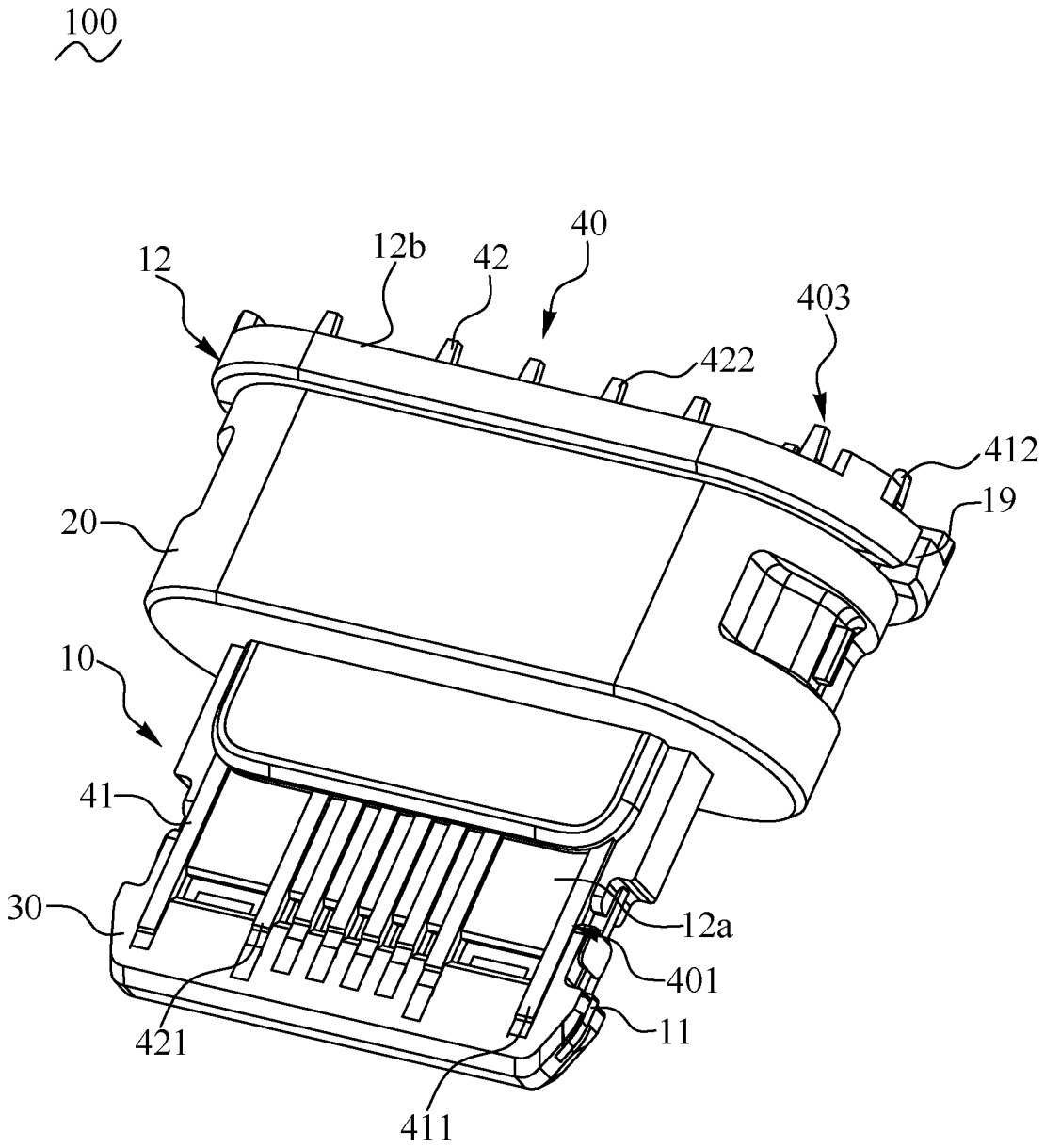
FIG. 1 is a perspective view of a plug connector in accordance with the present invention.
Figure 2:
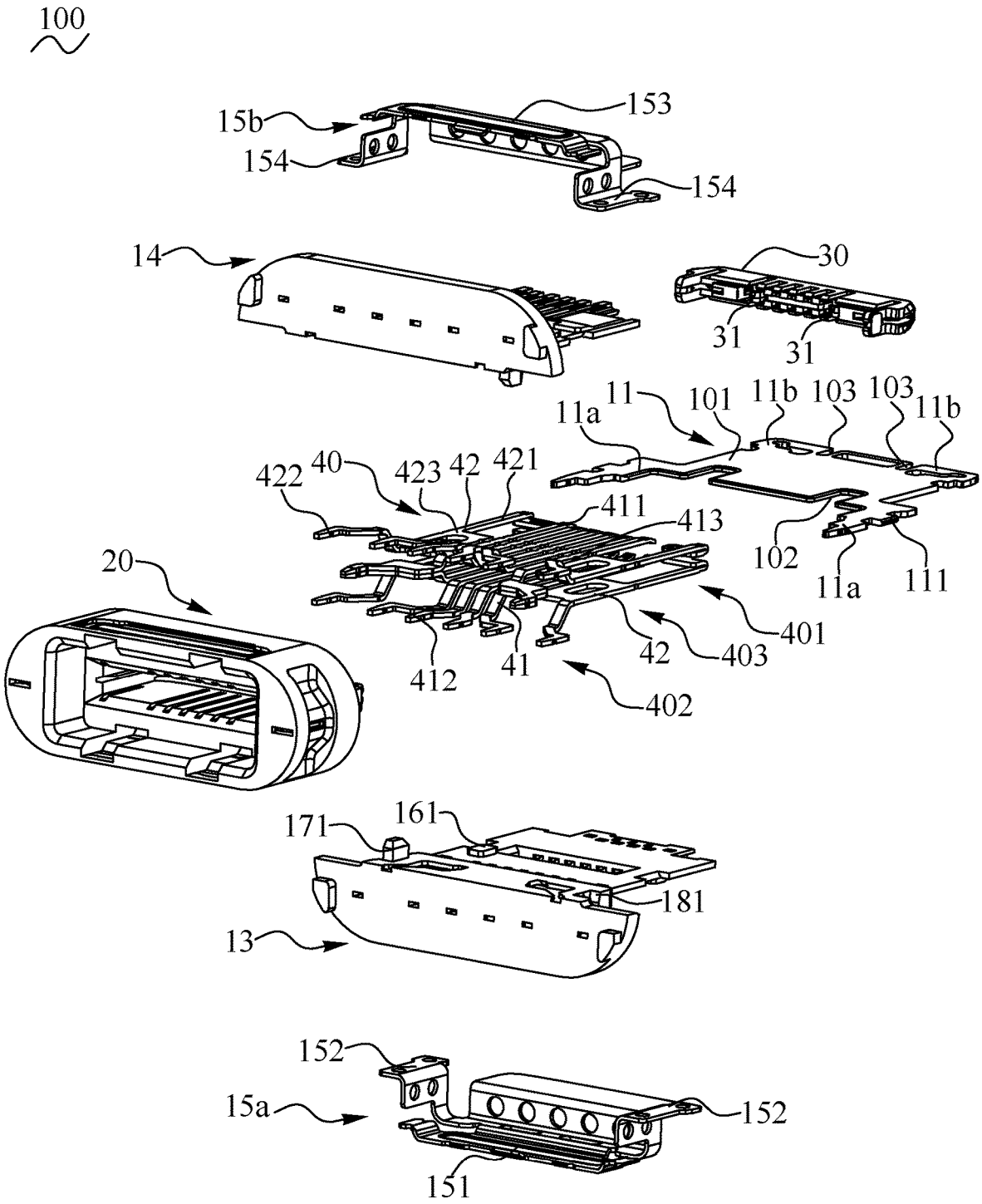
FIG. 2 is an exploded view of the plug connector of FIG. 1.
Figure 3:
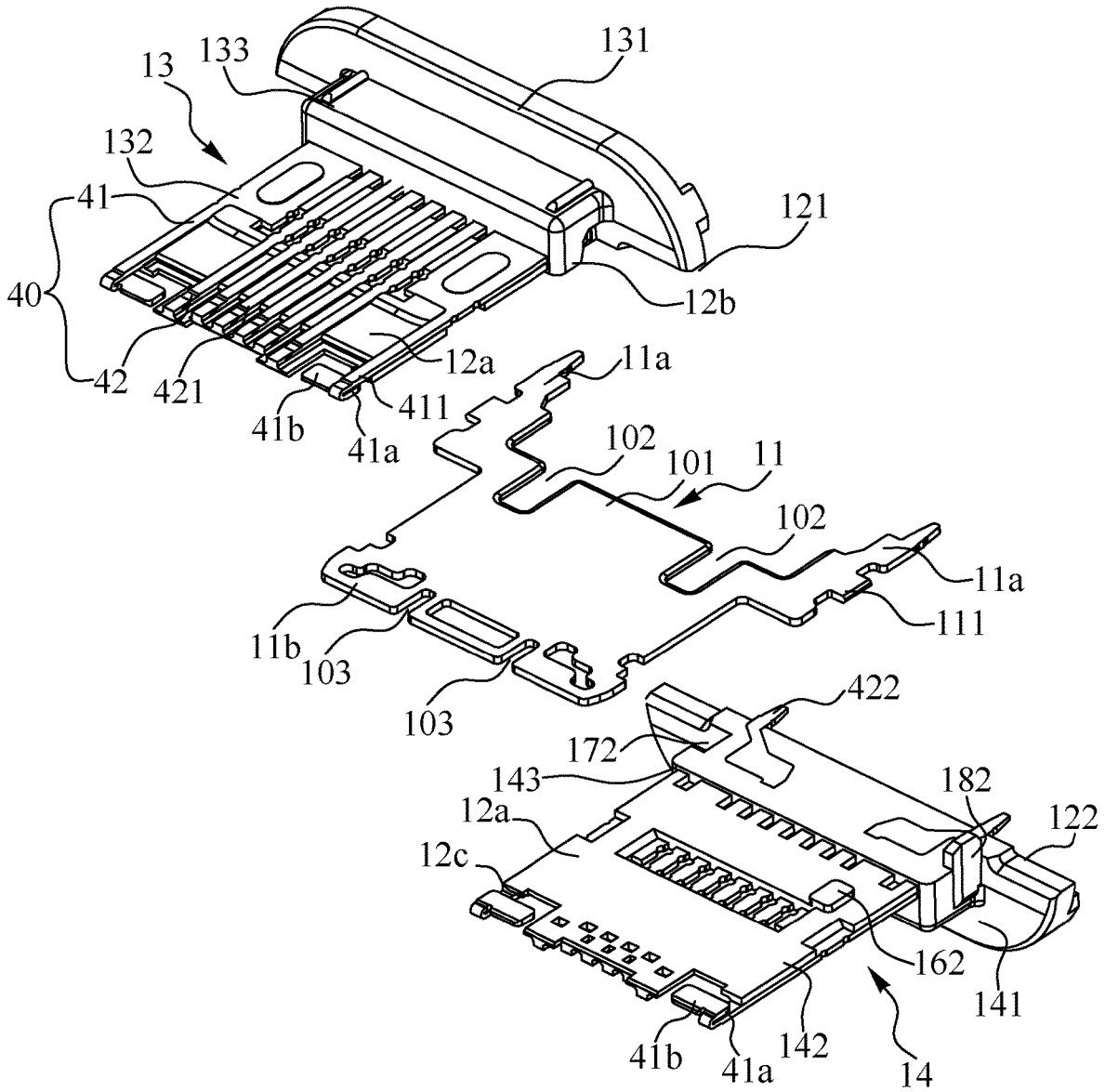
FIG. 3 is a partially exploded view showing that a main body and a main plate of the plug connector of FIG. 1.
Figure 4:
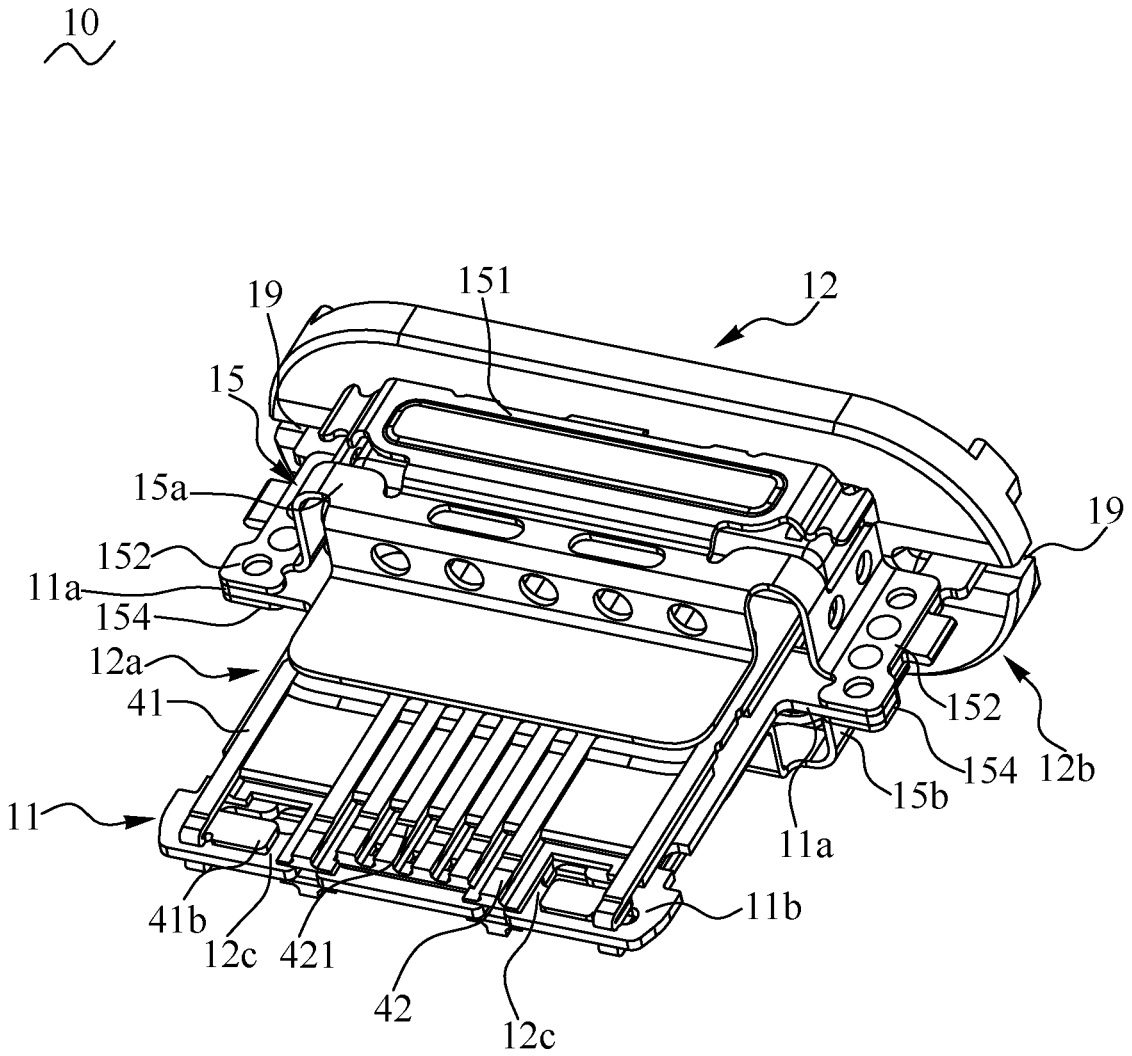
FIG. 4 is a partially perspective view of the plug connector of FIG. 1.
Figure 5:
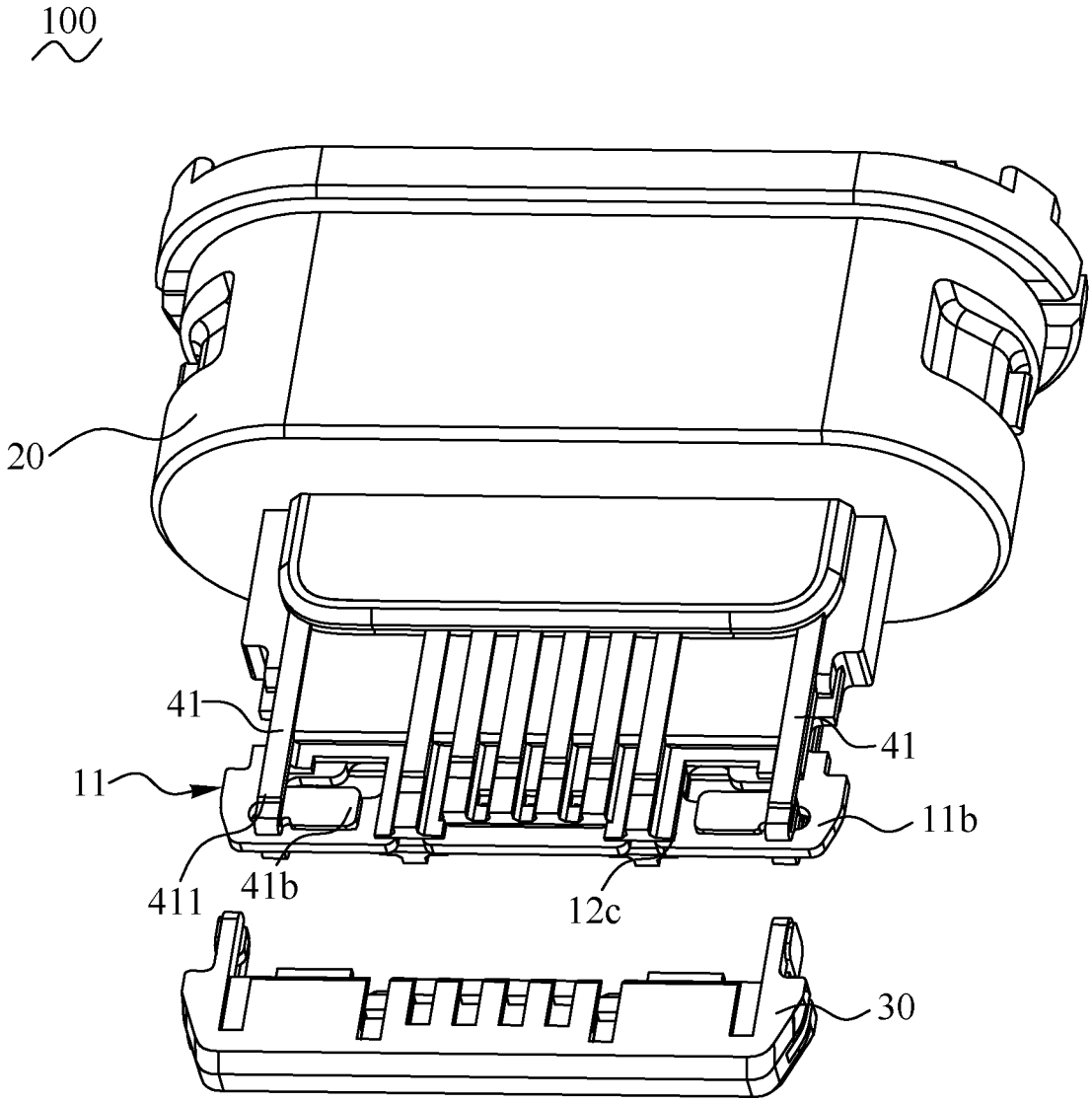
FIG. 5 is a partially exploded view of the plug connector of FIG. 1, wherein a protecting portion is separated from the plug connector.
Figure 6:
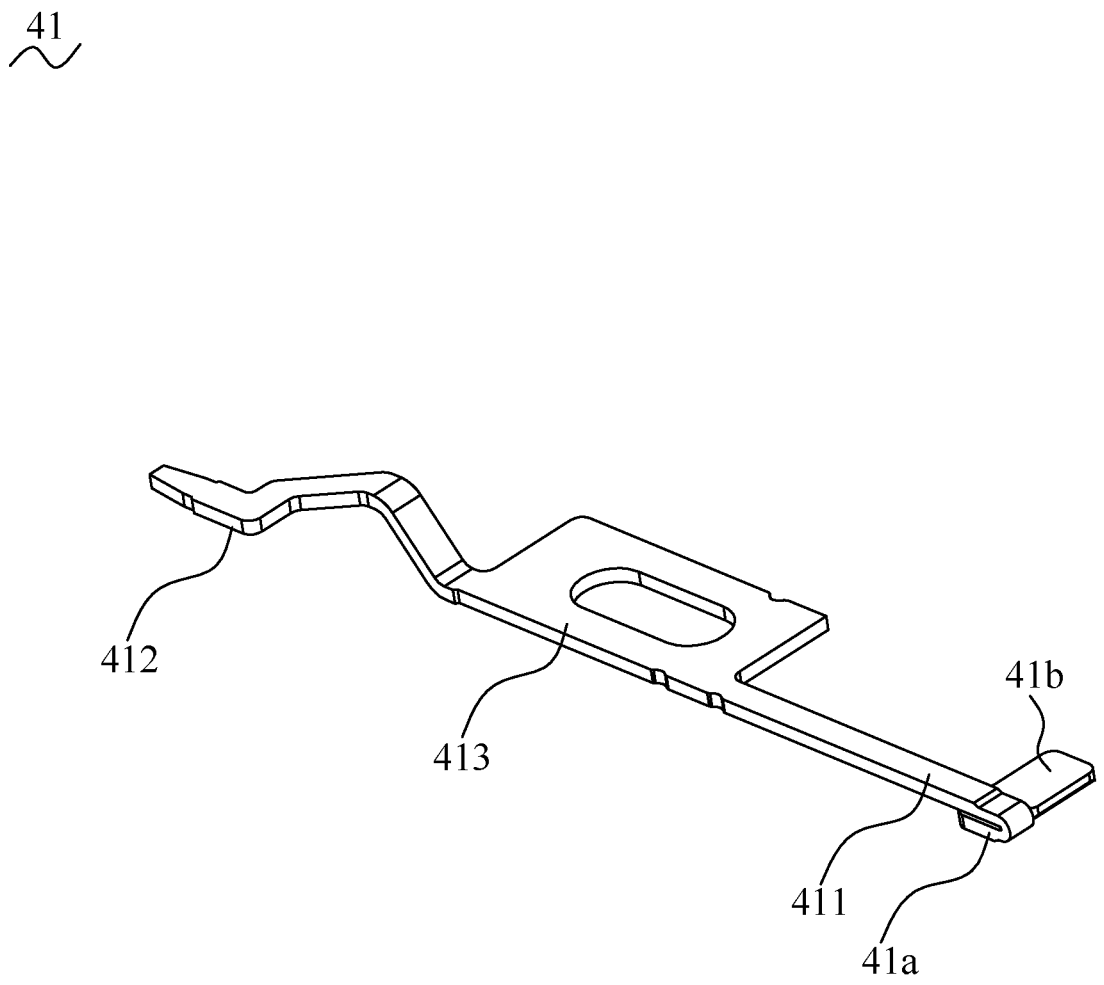
FIG. 6 is a perspective view of a ground terminal of the plug connector in accordance with the present invention.

With reference to FIG. 1, a plug connector 100 in accordance with the present invention is shown. The plug connector 100 includes a main body 10, an insulating housing 20, a protecting portion 30 and a plurality of terminals 40.

Referring to FIG. 1 to FIG. 4, the main body 10 includes a main plate 11, a base body 12 assembled to the main plate 11, and an outer ground shell 15. The main plate 11 has a rectangular base plate 101 disposed horizontally. Rears of two opposite sides of the base plate 101 protrude oppositely and then extend rearward to form two extending plates 11*a*. Middles of two opposite outer surfaces of the two extending plates 11*a* protrude oppositely to form two protruding plates 111. Two sides of a rear edge of the base plate 101 are recessed frontward to form two first notches 102. Two sides of a front edge of the base plate 101 are recessed rearward to form two second notches 103. Two sides of a front end of the base plate 101 are defined as two connecting plates 11*b* corresponding to two inner sides of the two extending plates 11*a*, respectively. Two opposite outer surfaces of the two connecting plates 11*b* are arched oppositely outward. The two second notches 103 are located between the two connecting plates 11*b*.

The base body 12 has an assembling end 12*b* disposed to a rear end thereof, and a connecting end 12*a* connected with a middle of a front of the assembling end 12*b*. The main plate 11 is fastened in the assembling end 12*b* and the connecting end 12*a*. Two opposite sides of a front end of the connecting end 12*a* are recessed inward to form two locking grooves 12*c* corresponding to the two connecting plates 11*b*, respectively. The base body 12 includes an upper base body 13 and a lower base body 14. Preferably, the upper base body 13 and the lower base body 14 have the same shapes. The upper base body 13 is matched with the lower base body 14. The plurality of the terminals 40 are divided into two groups of the terminals 40. Each terminal 40 extends longitudinally. One group of the terminals 40 are integrally molded to the upper base body 13. The one group of the terminals 40 are arranged transversely to the upper base body 13. The other group of the terminals 40 are integrally molded to the lower base body 14. The other group of the terminals 40 are arranged transversely to the lower base body 14. The upper base body 13 and the one group of the terminals 40 are mounted on the lower base body 14 and the other group of the terminals 40. Rear ends of the plurality of the terminals 40 are exposed to rear surfaces of the upper base body 13 and the lower base body 14. The one group of the terminals 40 fastened to the upper base body 13 are mutually corresponding to the other group of the terminals 40 fastened to the lower base body 14.

One side surface of a rear end of the upper base body 13 protrudes outward and then extends downward to form an upper fastening block 171. The other side surface of the rear end of the upper base body 13 is recessed inward to form an upper fastening groove 181. One side surface of the rear end of the lower base body 14 is recessed inward to form a lower fastening groove 172 corresponding to and matched with the upper fastening block 171. The other side surface of the rear end of the lower base body 14 protrudes outward and then extends upward to form a lower fastening block 182 corresponding to and matched with the upper fastening groove 181. One side of a bottom surface of the upper base body 13 protrudes downward to form an upper buckling block 161. One side of a top surface of the lower base body 14 facing the other side of the bottom surface of the upper base body 13 protrudes upward to form a lower buckling block 162.

The upper fastening block 171 is fastened in the lower fastening groove 172. The lower fastening block 182 is fastened in the upper fastening groove 181. The upper buckling block 161 is positioned on the top surface of the lower base body 14. The lower buckling block 162 is positioned on the bottom surface of the upper base body 13. The top surface of the lower base body 14 faces to and is spaced from the bottom surface of the upper base body 13. Preferably, the upper buckling block 161 and the lower buckling block 162 are of the same shapes. The upper fastening block 171 and the lower fastening block 182 are of the same shapes. The upper fastening groove 181 and the lower fastening groove 172 are of the same shapes.

The upper base body 13 has an upper base portion 131 disposed vertically, an upper protruding portion 133 extended frontward from a lower portion of a front surface of the upper base portion 131, and an upper extending board 132 extended frontward from a lower portion of a front surface of the upper protruding portion 133. Two opposite sides of a bottom surface of the upper base portion 131 are recessed upward to form two upper insertion grooves 121. The lower base body 14 has a lower base portion 141 disposed vertically, a lower protruding portion 143 extended frontward from an upper portion of a front surface of the lower base portion 141, and a lower extending board 142 extended frontward from an upper portion of a front surface of the lower protruding portion 143. The lower base portion 141, the upper protruding portion 133, the upper base portion 131 mounted on the lower base portion 141, and the lower protruding portion 143 mounted on the upper protruding portion 133 together define the assembling end 12*b*. The upper extending board 132 and the lower extending board 142 together define the connecting end 12*a*. Two opposite sides of a top surface of the lower base portion 141 are recessed downward to form two lower insertion grooves 122. The two upper insertion grooves 121 are corresponding to and combined with the two lower insertion grooves 122 to form two insertion grooves 19.

The main plate 11 is fastened between the upper base body 13 and the lower base body 14. The upper base body 13 is mounted on a top surface of the main plate 11, and the lower base body 14 is mounted to a bottom surface of the main plate 11. The upper buckling block 161 and the lower buckling block 162 are buckled in the two first notches 102. The two extending plates 11*a* are exposed out of the base body 12. Tail ends of the two extending plates 11*a* project beyond the rear surfaces of the upper base body 13 and the lower base body 14 through the two insertion grooves 19.

The outer ground shell 15 is mounted around a front of the assembling end 12*b* and connected with the main plate 11. The outer ground shell 15 surrounds the upper protruding portion 133 and the lower protruding portion 143. The outer ground shell 15 includes an upper ground shell 15*a* and a lower ground shell 15*b*. Preferably, the upper ground shell 15*a* and the lower ground shell 15*b* have the same shapes. The upper ground shell 15*a* and the lower ground shell 15*b* are matched with each other. The upper ground shell 15*a* and the lower ground shell 15*b* are symmetrical to each other with respect to the main plate 11. The upper ground shell 15*a* has a U-shaped upper assembling portion 151 of which a mouth faces downward, and two upper connecting pieces 152 extended oppositely outward from two opposite sides of the upper assembling portion 151. The lower ground shell 15*b* has a U-shaped lower assembling portion 153 of which a mouth faces upward, and two lower connecting pieces 154 extended oppositely outward from two opposite sides of the lower assembling portion 153.

The upper ground shell 15*a* is mounted to the upper base body 13, and the lower ground shell 15*b* is mounted to the lower base body 14. The upper assembling portion 151 is mounted to the upper protruding portion 133 of the upper base body 13, and the lower assembling portion 153 is mounted to the lower protruding portion 143 of the lower base body 14. One extending plate 11*a* is clamped between one upper connecting piece 152, and one lower connecting piece 154 facing the one upper connecting piece 152. The other extending plate 11*a* is clamped between the other upper connecting piece 152 and the other lower connecting piece 154. The one extending plate 11*a* is soldered between the one upper connecting piece 152, and the one lower connecting piece 154 facing the one upper connecting piece 152. The other extending plate 11*a* is soldered between the other upper connecting piece 152 and the other lower connecting piece 154. The base body 12, the main plate 11 and the plurality of the terminals 40 are fastened in the outer ground shell 15 by virtue of the two upper connecting pieces 152 and the two lower connecting pieces 154 being soldered with the two extending plate 11*a*. Specifically, the one extending plate 11*a* is soldered between the one upper connecting piece 152, and the one lower connecting piece 154 facing the one upper connecting piece 152, and the other extending plate 11*a* is soldered between the other upper connecting piece 152 and the other lower connecting piece 154, so that the base body 12, the main plate 11 and the plurality of the terminals 40 are fastened in the outer ground shell 15.

When the outer ground shell 15 is directly exposed outside, the outer ground shell 15 is easily caused to be deformed in use, consequently, a normal use of the plug connector 100 is affected. So the insulating housing 20 surrounds and is integrally molded to the outer ground shell 15 by way of an envelop injection, the outer ground shell 15 is further reinforced to make the outer ground shell 15 be uneasily deformed. The two protruding plates 111 project out of two opposite sides of the insulating housing 20.

Referring to FIG. 1 to FIG. 6, the plurality of the terminals 40 mounted to the base body 12, include a plurality of ground terminals 41 and a plurality of signal terminals 42. The plurality of ground terminals 41 are mounted to two opposite sides of the base body 12. The plurality of the signal terminals 42 are mounted to a middle of the base body 12 and disposed among the plurality of the ground terminals 41. Each terminal 40 has a contact portion 401, a connecting portion 403 connected with a rear end of the contact portion 401, and a soldering portion 402 connected with a rear end of the connecting portion 403. The contact portions 401 of the plurality of the terminals 40 are exposed to a top surface and a bottom surface of the connecting end 12*a*, the connecting portions 403 of the plurality of the terminals 40 are mounted to a junction between the connecting end 12*a* and the assembling end 12*b*, and the soldering portions 402 of the plurality of the terminals 40 project out of a rear surface of the assembling end 12*b*. Specifically, the plurality of the ground terminals 41 include four ground terminals 41. The one group of the terminals 40 include two ground terminals 41, and multiple signal terminals 42 located between the two ground terminals 41. The other group of the terminals 40 include the other two ground terminals 41, and the other remaining signal terminals 42 located between the other two ground terminals 41. The two ground terminals 41 of the one group of the terminals 40 are mounted to two opposite sides of the upper base body 13. The two ground terminals 41 of the other group of the terminals 40 are mounted to two opposite sides of the lower base body 14.

Each ground terminal 41 has a first contact portion 411, a first connecting portion 413 extended rearward from the first contact portion 411, and a first soldering portion 412 bent downward from the first connecting portion 413. Each signal terminal 42 has a second contact portion 421, a second connecting portion 423 extended rearward from a rear end of the second contact portion 421, and a second soldering portion 422 slantwise bent upward and then extending rearward from a rear end of the second connecting portion 423. The first contact portions 411 of the plurality of the ground terminals 41 and the second contact portions 421 of the plurality of the signal terminals 42 are exposed to a top surface of the upper extending board 132 of the upper base body 13 and a bottom surface of the lower extending board 142 of the lower base body 14. The first soldering portions 412 of the plurality of the ground terminals 41 and the second soldering portions 422 of the plurality of the signal terminals 42 are exposed beyond the rear surfaces of the upper base body 13 and the lower base body 14.

When the plug connector 100 is inserted into or withdrawal from a docking port (not shown), in order to avoid the plurality of the ground terminals 41 being deformed or broken, the two connecting plates 11*b* are exposed out of the connecting end 12*a* through the two locking grooves 12*c*. Each ground terminal 41 further has a propping portion 41*a* and a soldering pad 41*b*. A front end of the contact portion 401 of each ground terminal 41 has the soldering pad 41*b* fastened to the main plate 11. A free end of the contact portion 401 which is the first contact portion 411 of each ground terminal 41 is folded to form the propping portion 41*a*, and the propping portion 41*a* faces to and is parallel with the contact portion 401 which is the first contact portion 411 of each ground terminal 41. The propping portion 41*a* and the contact portion 401 are integrally formed to each ground terminal 41. The propping portions 41*a* of the contact portions 401 of the plurality of the ground terminals 41 are connected with the main plate 11.

An inner side of the propping portion 41*a* of each ground terminal 41 extends towards the connecting end 12*a* to form the soldering pad 41*b*. The soldering pad 41*b* is perpendicular to the propping portion 41*a* of each ground terminal 41 and is parallel with the contact portion 401 which is the first contact portion 411 of each ground terminal 41. The soldering pads 41*b* of the plurality of the ground terminals 41 are received in the two locking grooves 12*c*. Two soldering pads 41*b* of the two ground terminals 41 of the one group of the terminals 40 are received in upper portions of the two locking grooves 12*c*. Two soldering pads 41*b* of the two ground terminals 41 of the other group of the terminals 40 are received in lower portions of the two locking grooves 12*c*. The soldering pads 41*b* of the plurality of the ground terminals 41 are fastened to and connected with the two connecting plates 11*b* of the main plate 11. The soldering pads 41*b* of the plurality of the ground terminals 41 are soldered with the two connecting plates 11*b* of the main plate 11 through the two locking grooves 12*c*. The propping portion 41*a* and the soldering pad 41*b* of each ground terminal 41 are integrally formed to each ground terminal 41.

When the plug connector 100 is inserted into the docking port, the docking port is equipped with two elastic pieces disposed to two opposite sides of the docking port, because the propping portions 41*a* of the plurality of the ground terminals 41 increase bearing forces and the soldering pads 41*b* of the plurality of the ground terminals 41 are soldered to the two connecting plates 11*b* of the main plate 11, even though the two elastic pieces of the two opposite sides of the docking port abrade plastics of two sides of the protecting portion 30, each ground terminal 41 is uneasily deformed or broken, so that a normal use and a life of the plug connector 100 is ensured.

When the plug connector 100 is used in insertion and withdrawal processes, in order to avoid a tilt phenomenon or a deformation phenomenon of the first contact portions 411 of the plurality of the ground terminals 41 and the second contact portions 421 of the plurality of the signal terminals 42 being caused, the protecting portion 30 surrounds and is integrally molded to front ends of the contact portions 401 of the plurality of the terminals 40 and the front end of the connecting end 12*a* by way of the envelop injection, so interstices between the connecting end 12*a* and the main plate 11, and gaps among the plurality of the terminals 40 are sealed. The protecting portion 30 is integrally molded to front ends of the upper extending board 132 and the lower extending board 142 by way of the envelop injection, interstices among the upper extending board 132, the lower extending board 142 and the main plate 11, and the gaps among the plurality of the terminals 40 are sealed. So that the tilt phenomenon or the deformation phenomenon of the first contact portions 411 of the plurality of the ground terminals 41 and the second contact portions 421 of the plurality of the signal terminals 42 are prevented from being caused. Two opposite sides of a rear of the protecting portion 30 has two insertion blocks 31 matched with the two second notches 103. The two insertion blocks 31 are inserted into the two second notches 103.

As described above, when the plug connector 100 is used in the insertion and withdrawal processes, in order to avoid the tilt phenomenon or the deformation phenomenon of the first contact portions 411 of the plurality of the ground terminals 41 and the second contact portions 421 of the plurality of the signal terminals 42 being caused, the protecting portion 30 is integrally molded to the front end of the connecting end 12*a* by way of the envelop injection, so the interstices between the connecting end 12*a* and the main plate 11, and the gaps among the plurality of the terminals 40 are sealed, thereby the plug connector 100 has a waterproof function. Furthermore, the propping portions 41*a* of the plurality of the ground terminals 41 increase the bearing forces and the soldering pads 41*b* of the plurality of the ground terminals 41 are soldered to the two connecting plates 11*b* of the main plate 11, even though the two elastic pieces of the two opposite sides of the docking port abrade the plastics of the two sides of the protecting portion 30, the plug connector 100 prevents each ground terminal 41 thereof from being deformed or broken, so that each ground terminal 41 is uneasily deformed or broken. As a result, the normal use and the life of the plug connector 100 is ensured.

What is claimed is:

1. A plug connector, comprising:

a main body including a main plate, a base body assembled to the main plate, and an outer ground shell, the base body having an assembling end, and a connecting end connected with a front of the assembling end, the outer ground shell being mounted around the assembling end, the main plate having a base plate disposed horizontally, two sides of a front end of the base plate being defined as two connecting plates, two opposite outer surfaces of the two connecting plates being arched oppositely outward, two opposite sides of a front end of the connecting end being recessed inward to form two locking grooves corresponding to the two connecting plates, respectively;

a plurality of terminals mounted to the base body, including a plurality of ground terminals and a plurality of signal terminals, the plurality of the ground terminals being mounted to two opposite sides of the base body, the plurality of the signal terminals being mounted to a middle of the base body and disposed among the plurality of the ground terminals, each terminal having a contact portion, a connecting portion connected with a rear end of the contact portion, and a soldering portion connected with a rear end of the connecting portion, the contact portions of the plurality of the terminals being exposed to a top surface and a bottom surface of the connecting end, the connecting portions of the plurality of the terminals being mounted to a junction between the connecting end and the assembling end, and the soldering portions of the plurality of the terminals projecting out of a rear surface of the assembling end, the contact portion of each ground terminal having a soldering pad fastened to the main plate, a free end of the contact portion of each ground terminal being folded to form a propping portion, and the propping portion facing to and being parallel with the contact portion of each ground terminal, the propping portion and the contact portion being integrally formed to each ground terminal, an inner side of the propping portion of each ground terminal extending towards the connecting end to form the soldering pad, the soldering pads of the plurality of the ground terminals being received in the two locking grooves, the soldering pads of the plurality of the ground terminals being fastened to and connected with the two connecting plates of the main plate;

an insulating housing surrounding and integrally molded to the outer ground shell by way of an envelop injection; and a protecting portion surrounding and integrally molded to front ends of the contact portions of the plurality of the terminals and a front end of the connecting end by way of the envelop injection.

2. The plug connector as claimed in claim 1, wherein the soldering pads of the plurality of the ground terminals are soldered with the two connecting plates of the main plate through the two locking grooves.

3. The plug connector as claimed in claim 1, wherein the propping portions of the contact portions of the plurality of the ground terminals are connected with the main plate, the soldering pad is perpendicular to the propping portion of each ground terminal and is parallel with the contact portion of each ground terminal, the propping portion and the soldering pad of each ground terminal are integrally formed to each ground terminal.

4. The plug connector as claimed in claim 1, wherein the base body includes an upper base body and a lower base body, the outer ground shell includes an upper ground shell and a lower ground shell, the upper ground shell has a U-shaped upper assembling portion of which a mouth faces downward, and two upper connecting pieces extended oppositely outward from two opposite sides of the upper assembling portion, the lower ground shell has a U-shaped lower assembling portion of which a mouth faces upward, and two lower connecting pieces extended oppositely outward from two opposite sides of the lower assembling portion, the upper assembling portion is mounted to the upper base body, and the lower assembling portion is mounted to the lower base body, the main plate has the base plate, rears of two opposite sides of the base plate protrude oppositely and then extend rearward to form two extending plates, one extending plate is clamped between one upper connecting piece and one lower connecting piece facing the one upper connecting piece, the other extending plate is clamped between the other upper connecting piece and the other lower connecting piece.

5. The plug connector as claimed in claim 4, wherein the one extending plate is soldered between the one upper connecting piece, and the one lower connecting piece facing the one upper connecting piece, the other extending plate is soldered between the other upper connecting piece and the other lower connecting piece.

6. The plug connector as claimed in claim 4, wherein the main plate has the base plate disposed horizontally, two sides of a rear edge of the base plate are recessed frontward to form two first notches, one side of a bottom surface of the upper base body protrudes downward to form an upper buckling block, one side of a top surface of the lower base body facing the other side of the bottom surface of the upper base body protrudes upward to form a lower buckling block, the upper buckling block and the lower buckling block are buckled in the two first notches.

7. The plug connector as claimed in claim 4, wherein one side surface of a rear end of the upper base body protrudes outward and then extends downward to form an upper fastening block, the other side surface of the rear end of the upper base body is recessed inward to form an upper fastening groove, one side surface of a rear end of the lower base body is recessed inward to form a lower fastening groove, the other side surface of the rear end of the lower base body protrudes outward and then extends upward to form a lower fastening block, the upper fastening block is fastened in the lower fastening groove, the lower fastening block is fastened in the upper fastening groove.

8. The plug connector as claimed in claim 1, wherein the main plate has the base plate, two sides of a front edge of the base plate are recessed rearward to form two second notches, two opposite sides of a rear of the protecting portion has two insertion blocks matched with the two second notches, the two insertion blocks are inserted into the two second notches.

9. A plug connector, comprising:

a main body including a main plate, a base body assembled to the main plate, and an outer ground shell, the base body having an assembling end, and a connecting end connected with a front of the assembling end, the outer ground shell being mounted around the assembling end, the base body including an upper base body and a lower base body, the outer ground shell including an upper ground shell and a lower ground shell, the upper ground shell having a U-shaped upper assembling portion of which a mouth faces downward, and two upper connecting pieces extended oppositely outward from two opposite sides of the upper assembling portion, the lower ground shell having a U-shaped lower assembling portion of which a mouth faces upward, and two lower connecting pieces extended oppositely outward from two opposite sides of the lower assembling portion, the upper assembling portion being mounted to the upper base body, and the lower assembling portion being mounted to the lower base body, the main plate having a base plate, rears of two opposite sides of the base plate protruding oppositely and then extending rearward to form two extending plates, one extending plate being clamped between one upper connecting piece and one lower connecting piece facing the one upper connecting piece, the other extending plate being clamped between the other upper connecting piece and the other lower connecting piece;

a plurality of terminals mounted to the base body, including a plurality of ground terminals mounted to two opposite sides of the base body, and a plurality of signal terminals mounted to a middle of the base body and disposed among the plurality of the ground terminals, each terminal having a contact portion, a connecting portion connected with a rear end of the contact portion, and a soldering portion connected with a rear end of the connecting portion, the contact portions of the plurality of the terminals being exposed to a top surface and a bottom surface of the connecting end, and the soldering portions of the plurality of the terminals projecting out of a rear surface of the assembling end, a free end of the contact portion of each ground terminal being folded to form a propping portion, an inner side of the propping portion of each ground terminal extending towards the connecting end to form a soldering pad fastened to the main plate;

an insulating housing surrounding and integrally molded to the outer ground shell; and a protecting portion surrounding and integrally molded to front ends of the contact portions of the plurality of the terminals and a front end of the connecting end.

10. A plug connector, comprising:

a main body including a main plate, a base body assembled to the main plate, and an outer ground shell, the base body having an assembling end, and a connecting end connected with a front of the assembling end, the outer ground shell being mounted around the assembling end, the main plate having a base plate, two sides of a front end of the base plate being defined as two connecting plates, two opposite sides of a front end of the connecting end being recessed inward to form two locking grooves, respectively;

a plurality of terminals mounted to the base body, including a plurality of ground terminals mounted to two opposite sides of the base body, each terminal having a contact portion, a connecting portion connected with a rear end of the contact portion, and a soldering portion connected with a rear end of the connecting portion, the contact portions of the plurality of the terminals being exposed to a top surface and a bottom surface of the connecting end, and the soldering portions of the plurality of the terminals projecting out of a rear surface of the assembling end, a free end of the contact portion of each ground terminal being folded to form a propping portion, an inner side of the propping portion of each ground terminal extending towards the connecting end to form a soldering pad, the soldering pads of the plurality of the ground terminals being received in the two locking grooves, the soldering pads of the plurality of the ground terminals being fastened to and connected with the two connecting plates of the main plate;

an insulating housing surrounding and integrally molded to the outer ground shell; and a protecting portion surrounding and integrally molded to front ends of the contact portions of the plurality of the terminals and a front end of the connecting end.

11. The plug connector as claimed in claim 10, wherein the soldering pads of the plurality of the ground terminals are soldered with the two connecting plates of the main plate through the two locking grooves.

* * * * *